US005184749A

United States Patent [19]

Attenasio

[11] Patent Number: 5,184,749

[45] Date of Patent: Feb. 9, 1993

[54] PORTABLE DRAIN RECEPTACLE

[76] Inventor: Gladys A. Attenasio, 341 Eagle Dr., Jupiter, Fla. 33477

[21] Appl. No.: 897,906

[22] Filed: Jun. 12, 1992

[51] Int. Cl.[5] ..... B65D 21/02

[52] U.S. Cl. ..... 220/572; 220/736; 220/23.83; 15/257.01

[58] Field of Search ..... 220/735, 736, 4.03, 220/4.26, 4.27, 571, 572, 571.1, DIG. 6, 601, 485, 486, 487, 488, 23.83, 23.86, 501, 345, 4.08, 4.09, 4.24, 4.21, 480, 529, 533, 534, 553, 94 R; 15/257.01; 217/62

[56] References Cited

U.S. PATENT DOCUMENTS

| | | | |
|---|---|---|---|
| 224,490 | 2/1880 | Sturges | 220/4.27 |
| 1,663,224 | 3/1928 | Van Der Kley | 220/553 |
| 2,278,850 | 4/1942 | Hammond | 217/62 |
| 2,671,239 | 3/1954 | Wisner | 220/501 |
| 2,807,387 | 9/1957 | Siciliano | 220/4.27 |
| 3,182,856 | 5/1965 | Goltz | 220/345 |
| 3,446,386 | 5/1969 | Wellington | 220/4.27 |
| 3,643,812 | 2/1972 | Mander et al. | 220/DIG. 6 |
| 4,798,307 | 1/1989 | Evrard | 220/501 |
| 4,850,484 | 7/1989 | Denman | 220/480 |
| 4,889,232 | 12/1989 | Asleson | 220/533 |
| 5,050,760 | 9/1991 | Garcia | 220/94 R |
| 5,088,618 | 2/1992 | Colombo | 220/486 |
| 5,095,579 | 3/1992 | Becker | 220/4.26 |

FOREIGN PATENT DOCUMENTS

| | | | |
|---|---|---|---|
| 623839 | 5/1949 | United Kingdom | 220/571 |

*Primary Examiner*—Allan N. Shoap
*Assistant Examiner*—S. Castellano
*Attorney, Agent, or Firm*—Norman Friedland

[57] ABSTRACT

A hand held apparatus for holding, storing and draining in separate subcompartments cleansing utensils such as scouring pads, sponges, soaps, brushes and the likes in a single container that can rest on the top of a counter and be stored in the back of a cabinet door. A removable collection basin is slidably mounted on the bottom to collect and hold the dripping liquid from these utensils. The "caddie" type of container being sufficiently small to be hand carried and its components being easy to separate so as to be washed in a household type dishwasher.

3 Claims, 3 Drawing Sheets

PORTABLE DRAIN RECEPTACLE

BACKGROUND OF THE INVENTION

1. Technical Field

This invention relates to receptacles that include a removable catch basin for portably carrying and storing cleansing utensils used in and around the sink of a kitchen and the like. The present invention concerns itself with a device that holds cleansing utensils in a single receptacle that collects the dripping liquid and is capable of being stored in a convenient location for use at a later time, while being sufficiently small to be conveniently handled and periodically cleaned.

2. Background of the Invention

There are a number of devices disclosed in the prior art that are capable of storing articles that are susceptible of becoming wet that have means for collecting the dripping water in a separate reservoir. For example, U.S. Pat. No. 3,920,144 granted to R. Calleen on Nov. 18, 19 describes such a device which is particularly adapted for storing footwear. The dripping water is collected in a lower basin separated by a grate and the water is removed by flowing the collected water through a drain plug. It, like other such devices disclosed in U.S. Pat. No. 3,920,144, supra, is basically for temporarily holding or storing articles. These types of receptacles typically remain in place and when no longer required they may be stored away. They do not retain the articles when deployed in the storage area, but rather are typically emptied prior to storage. Other patents as, for example, U.S. Pat. No. 1,363,590 granted to W. S. Hasskarl in Dec. 28, 1920, show receptacles with removable draining mechanism that are particularly adapted to hold and drain dishes and the like and they, too, are emptied when returned to storage.

None of the prior art devices are particularly adapted to hold and store cleansing utensils of the type that after use tend to drip water so that these utensils, like sponges, scouring pads, bars of soap, brushes and the like, are readily available for use on the next occasion. This invention contemplates a receptacle or "caddie" that is easy to handle, convenient to use, holds the utensils in a single container that collects the drippings in a receptacle that is easily handled, convenient to use, holds the necessary utensils in a single container and is easy to periodically clean, as by a dishwasher, for example. In addition to the above, my inventive receptacle can be stored on the back of a cabinet door or in a remote area without taking up much space and when in use, can be set to rest on the top of a counter in proximity to the location where the work is taking place having all the necessary cleansing utensils at one location.

SUMMARY OF THE INVENTION

An object of this invention is to provide an improved receptive for holding and storing cleansing utensils that includes a removable catch basin for collecting and storing the liquid dripping off of these utensils.

A feature of this invention is to provide in a receptacle as described, subcompartments separated by wall means contoured on the top for easy removal of the contents and to prevent contamination of adjacent compartments.

Another feature of this invention is to provide a receptacle as described, means for allowing the recirculation of ambient air through the drain basin and subcompartments.

Another feature of this invention is to provide in a receptacle as described, means for hanging the receptacle on a vertical wall such as the back of a cabinet door.

Another feature of this invention is to provide in a receptacle as described, a handle that may be removable that rotates about its axis but does not interfere with the hanging capabilities of the receptacle.

The foregoing and other features of the present invention will become more apparent from the following description and accompanying drawings.

BEST MODE FOR CARRYING OUT THE INVENTION

Figure 1:
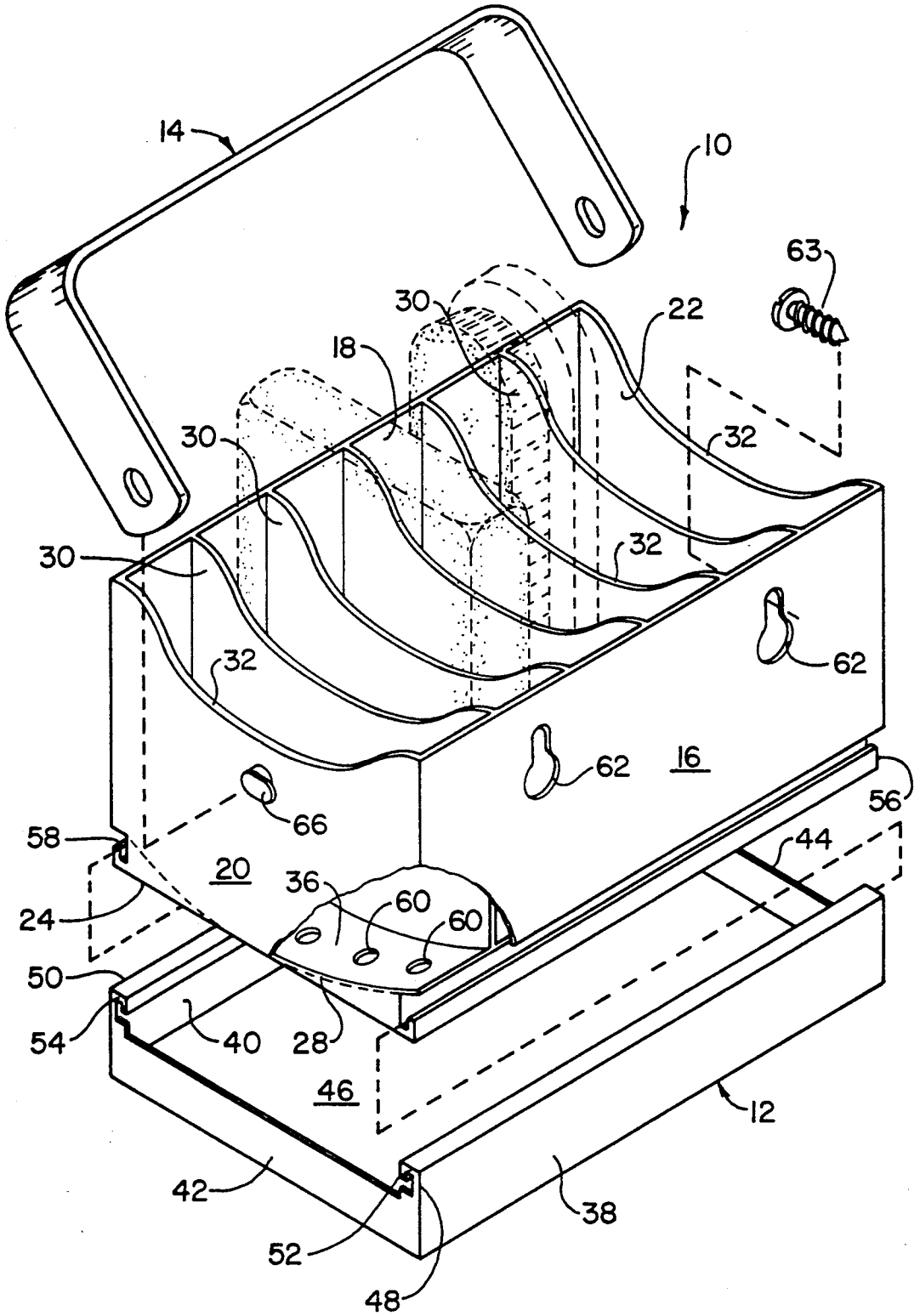
FIG. 1 is an exploded view in perspective illustrating the details of the invention.
Figure 2:
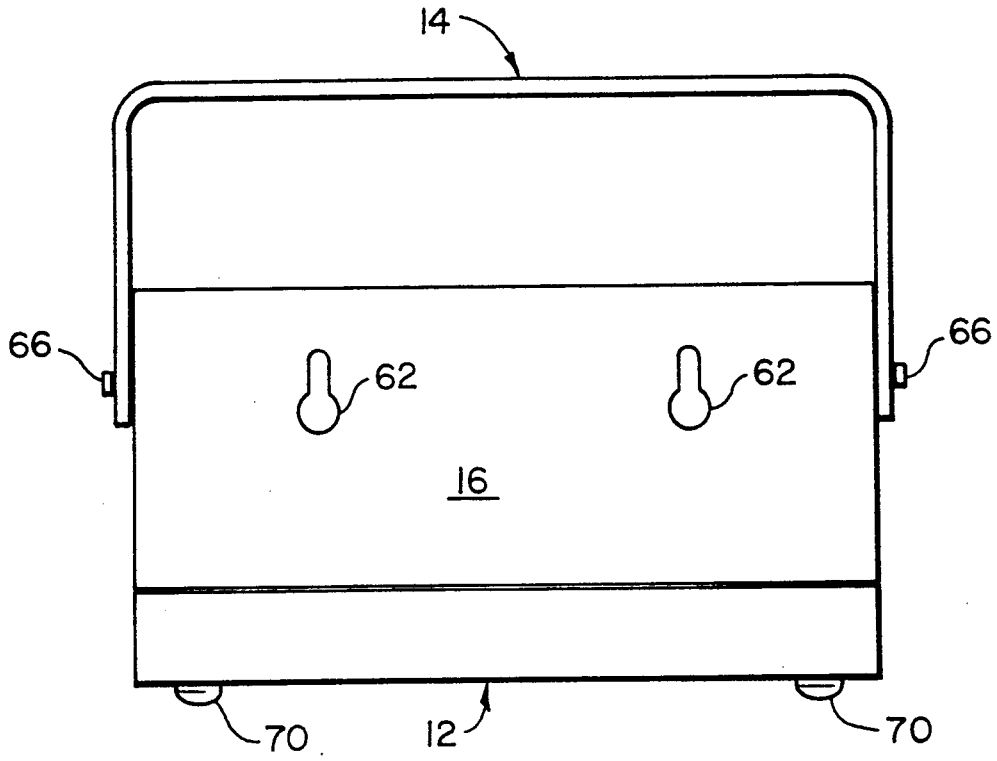
FIG. 2 is a side elevation view of the invention depicted in FIG. 1.
Figure 3:
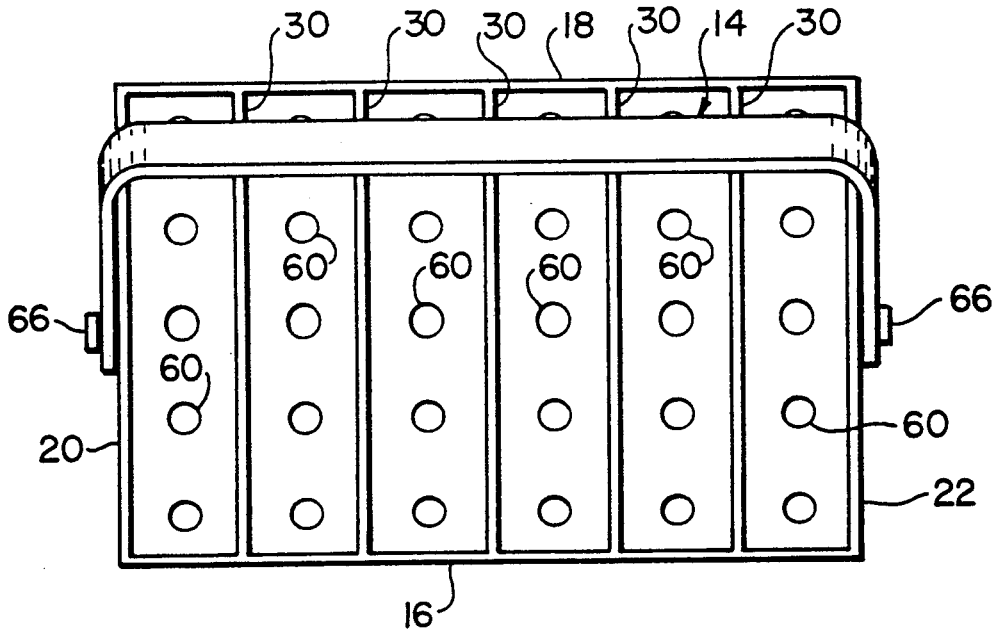
FIG. 3 is a top plan view of the invention.
Figure 4:
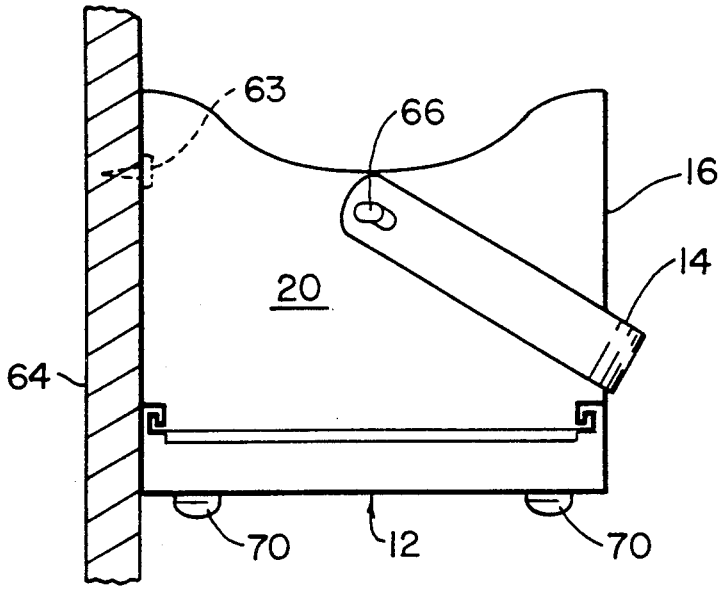
FIG. 4 is a view partly in section with a side view in elevation illustrating the invention attached to a vertical wall.

The invention can best be understood by referring to FIGS. 1–4 showing the invention as having an opened top receptacle generally illustrated by reference numeral 10 and a removable collecting basin 12 and a removable handle 14. For the purpose of this description the term "utensils" shall mean cleansing devices such as scouring pads, soaps (bars, powder or liquid), brushes, sponges and the like.

Receptacle 10 is preferably molded from a suitable plastic material into a unitary container consisting of parallel side walls 16 and 18, parallel end walls 20 and 22 and a bottom wall 24. The inner surface 28 of bottom wall 24 is contoured to form a trough for directing dripping fluid that may be retained in the utensils into basin 12. A plurality of spacer walls 30, either removable in a well known manner or molded integrally with the container to form subcompartments for holding the utensils and preventing adjacent compartments from being contaminated by each other. The top surface 32 of each spacer wall is contoured in a generally concave shape to make easy access to the utensils. The bottom surface 36 is likewise contoured to complement the bottom wall 28 for providing a tight fit and seal.

Collecting basin 12 is likewise molded into an integral opened top container from suitable plastic material having parallel side walls 38 and 40, parallel end walls 42 and 44 and bottom wall 46. The upper end portion 48 and 50 of side walls 38 and 40, respectively, extend above the end walls 42 and 44 and are "U-shaped" in cross section to define rails 52 and 54. These rails complement the rails 56 and 58 integrally formed in side walls 16 and 18, respectively, so that collecting basin 12 is removable by sliding one component relative to the other. The complementary rails are dimensioned to be snugly fitted relative to each other so that when in the operating position the collecting basin 12 will be firmly secured and won't inadvertently slip. The upper ends of end walls 42 and 44 are slightly recessed so that when assembled a space is formed between the upper surface of end walls 42 and 44 and the adjacent surface of the bottom wall 28. This allows for the recirculation of ambient air through the interior of the collecting basin 12 and the subcompartments. The plurality of holes 60 formed in the bottom wall 28 in each of the subcompartments have the dual purpose of draining the dripping fluid from the utensils that collect on the surface of the bottom wall 28 through holes 60 into collecting basin 12 and allowing the circulation of air through the subcompartments.

Side wall 16 may include a suitable slot 62 or pair of slots, as shown, or other supporting mechanism supporting the receptacle 10 to a vertical wall 64, such as the back of a cabinet, when the unit is being stored. In the preferred embodiment wood screws 63 are partly screwed into the back of a cabinet door and extend slightly to receive the receptacle 10 through the complementary slots 62. Of course, it is within the scope of this invention to use any type of suitable fastening means for this purpose. As is apparent from the foregoing the receptacle including the utensils can be stored out of the way, say from sink of a kitchen, when not in use and when still containing liquid. The contained liquid will eventually drip to the bottom of the container where it flows through holes 60 to the collecting basin 12. To periodically clean the receptacle and collecting basin the units can be easily separated and conveniently put into a dishwasher or the like.

Removable handle 14 may be included, if desired, by including a pair of diametrically opposed "L-shaped" lugs 66 extending from the end walls 20 and 24. Handle 14 consists of a "U-shaped relatively thin member molded out of plastic that carries the slots 68 at either end that engage in lugs 66 and deminsioned for the handle to rotate as shown. The receptacle may include plastic foot rests 70 located at the four corners of the bottom surface of bottom wall 46 of collecting basin 12 to hold the receptacle slightly above the counter top.

Figure 5:
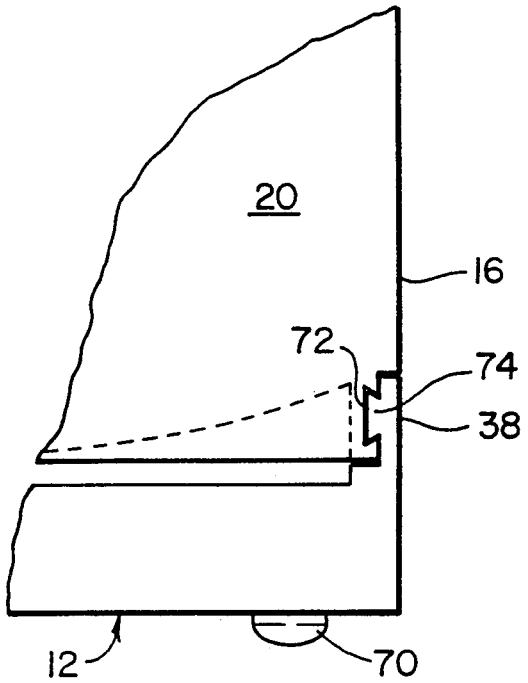
FIG. 5 is a partial view in elevation illustration another embodiment of this invention.

FIG. 5 exemplifies another embodiment of this invention and is identical to the one disclosed in FIGS. 1–4 except for the mounting mechanism for slidably supporting basin 12 to the container. (The same reference numerals apply to like elements in all the FIGS.) In this embodiment the sliding mechanism is a dove tail fitting including an elongated slot 72 extending along the bottom end of side walls 16 and 18 (only one wall being illustrated) and the complementing rail 74 projecting from the inner surface of the projecting end of side walls 38 and 40 (only one wall being illustrated) respectively. This permits the removable assembly of the collecting basin 12 to container while providing a snug fit in order to secure the basin 12 when in the assembled position, similarly to the embodiment disclosed in FIG. 1.

What has been shown by this invention is a convenient, portable receptacle for carrying utensils in "caddie" fashion and allowing for the storage of the container and utensils while permitting the dripping liquid to be collected and retained until removal is desired. The units can be separated for periodic cleansing by merely utilizing the ordinary household dishwasher.

Although this invention has been shown and described with respect to detailed embodiments thereof, it will be understood by those skilled in the art that various changes in form and detail thereof may be made without departing from the spirit and scope of the claimed invention.

I claim:

1. A hand held apparatus for holding, storing and collecting liquid draining from cleansing utensils comprising a first open ended container having opposing parallel front and back walls, a pair of opposing side walls, a bottom wall and a plurality of axially spaced vertical wall members extending from said side walls and between said front and back walls and said bottom wall defining a plurality of subcompartments for holding the cleansing utensils adapted for household cleaning, a slidably mounted removable basin for collecting and storing the liquid comprising a second open ended container being contiguous relative to said first container and having opposing parallel front and back walls, a pair of side walls, and a bottom wall, means for slidably mounting said first container relative to said second container including opposing complementary rails mounted on the face of the front and back walls of said first container and said second container to removably hold said first container and said second container in contiguous position relative to each other, spaced holes in said bottom wall in each of said subcompartments communicating with said second container through said opened end thereof for collecting the liquid from said utensils in said second container, said means for slidably mounting said first container to said second container includes an elongated slot fitting including an elongated slot formed in the bottom edge of said front wall and said back wall of one of said containers which locks with a complementary projection extending from the top edge of said front wall and said back wall of said other one of said containers.

2. A hand held apparatus as in claim 1 wherein the elongated slot fitting is of a dove tail type.

3. A hand held apparatus for holding, storing and collecting liquid draining from cleansing utensils comprising a first open ended container having opposing parallel front and back walls, a pair of opposing side walls, a bottom wall and a plurality of axially spaced vertical wall members extending from said side walls and between said front and back walls and said bottom wall defining a plurality of subcompartments for holding the cleansing utensils adapted for household cleaning, a slidably mounted removable basin for collecting and storing the liquid comprising a second open ended container being contiguous relative to said first container and having opposing parallel front and back walls, a pair of side walls, and a bottom wall, means for slidably mounting said first container relative to said second container including opposing complementary rails mounted on the face of the front and back walls of said first container and said second container to removably hold said first container and said second container in contiguous position relative to each other, spaced holes in said bottom wall in each of said subcompartments communicating with said second container through said opened end thereof for collecting the liquid from said utensils in said second container, the upperside of said bottom wall of said first container is concave shaped in the direction between said front wall and said back wall to define a trough in each of said subcompartments for directing the liquid that drains from each of said cleansing utensils toward the center of said subcompartments, the top edge of said plurality of axially spaced vertical wall members are recessed to define a lower section in said subcompartments for allowing the access to each of said utensils, the top edge of said pair of side walls of said first container are recessed to complement said recessed top edge of said plurality of axially spaced vertical wall members, means for attaching said apparatus on a vertical wall, and the top edge of each of said side walls of said second container is recessed to define a gap between said first container and said second container to permit the recirculation of air through said second container, said spaced holes in said bottom wall of said first container and said first container.

* * * * *